US011384561B2

(12) United States Patent
Molina

(10) Patent No.: US 11,384,561 B2
(45) Date of Patent: Jul. 12, 2022

(54) SYSTEM AND METHOD FOR CONSTRUCTING A RAILING

(71) Applicant: American Fence System, Inc., South Plainfield, NJ (US)

(72) Inventor: Jesus Molina, Martinsville, NJ (US)

(73) Assignee: American Fence System, Inc., South Plainfield, NJ (US)

( * ) Notice: Subject to any disclaimer, the term of this patent is extended or adjusted under 35 U.S.C. 154(b) by 80 days.

(21) Appl. No.: 16/887,106

(22) Filed: May 29, 2020

(65) Prior Publication Data

US 2020/0378148 A1 Dec. 3, 2020

Related U.S. Application Data

(60) Provisional application No. 62/854,383, filed on May 30, 2019.

(51) Int. Cl.
*E04H 17/14* (2006.01)
*E04F 11/18* (2006.01)

(52) U.S. Cl.
CPC ..... *E04H 17/1439* (2013.01); *E04F 11/1817* (2013.01); *E04F 11/1844* (2013.01); *E04F 2011/1821* (2013.01)

(58) Field of Classification Search
CPC ..... E04F 11/1817; E04F 11/1842; E04F 11/1844; E04F 11/2011; E04F 11/1819; E04F 11/1821; E04F 11/1823; E04F 11/1825; E04F 11/1827; E04H 17/14; E04H 17/1439; E04H 17/1413; E04H 17/1417; E04H 17/1426; B25G 3/18
See application file for complete search history.

(56) References Cited

U.S. PATENT DOCUMENTS 3,756,567 A * 9/1973 Murdock ..... E04F 11/181 256/21
4,982,933 A * 1/1991 Schultz ..... E04H 17/1447 256/65.06
5,454,548 A * 10/1995 Moore ..... E04H 17/1447 256/22
8,833,737 B2 * 9/2014 Langenwalter ..... E04H 17/1426 256/67
9,482,028 B2 * 11/2016 Springborn ..... E04H 17/1447
11,035,147 B2 * 6/2021 Burt ..... E04H 17/1439

(Continued)

*Primary Examiner* — Jonathan P Masinick
(74) *Attorney, Agent, or Firm* — Lerner, David, Littenberg, Krummholz & Mentlik, LLP

(57) ABSTRACT

A method for constructing a railing is provided, the railing having two substantially horizontal rails, including a top rail and a bottom rail substantially parallel to one another, and a plurality of pickets inserted between the rails such that the pickets terminate at a first end within the top rail and at a second end within the bottom rail. The top and bottom rails each include openings sized to receive the pickets after the top and bottom rails have been affixed to vertical posts. The rails may each include one or more tracks within an inner chamber, within which a locking strip is configured to slide. A depth of the top rail may be greater than a depth of the bottom rail. In this regard, when the top and bottom rails are affixed to the vertical posts, the picket can slide up into the top rail and then be inserted into the bottom rail, where it may rest.

19 Claims, 14 Drawing Sheets

(56) References Cited

U.S. PATENT DOCUMENTS

| | | | | |
|---|---|---|---|---|
| 2004/0188663 | A1* | 9/2004 | Stein | E04H 17/1439 256/59 |
| 2005/0045863 | A1* | 3/2005 | MacKay | E04H 17/1447 256/59 |
| 2008/0157049 | A1* | 7/2008 | Robbins | E04H 17/1439 256/65.12 |
| 2010/0237309 | A1* | 9/2010 | Ferris | E04F 11/1842 256/65.01 |
| 2014/0173830 | A1* | 6/2014 | Arthur | B25F 1/006 7/146 |
| 2015/0021534 | A1* | 1/2015 | Molina | E04H 17/1447 256/65.12 |
| 2015/0300041 | A1* | 10/2015 | Feeko | E04H 17/1417 256/65.12 |
| 2016/0097215 | A1* | 4/2016 | Molina | E04H 17/1439 256/65.12 |

* cited by examiner

SYSTEM AND METHOD FOR CONSTRUCTING A RAILING

CROSS-REFERENCE TO RELATED APPLICATIONS

This application claims the benefit of the filing date of U.S. Provisional Patent Application No. 62/854,383 filed May 30, 2019, the disclosure of which is hereby incorporated herein by reference.

BACKGROUND

Existing railing systems include a plurality of vertical pickets coupled to two horizontal rails. When one of the vertical pickets is damaged, repair or replacement of the picket can be cumbersome, time consuming, and costly.

BRIEF SUMMARY

Aspects of the present disclosure provide a method for constructing a railing having two substantially horizontal rails, including a top rail and a bottom rail substantially parallel to one another, and a plurality of pickets inserted between the rails such that the pickets terminate at a first end within the top rail and at a second end within the bottom rail. The top and bottom rails each include openings sized to receive the pickets after the top and bottom rails have been affixed to vertical posts. For example, the rails may each include one or more tracks within an inner chamber, within which a locking strip is configured to slide. A depth of the top rail may be greater than a depth of the bottom rail. In this regard, when the top and bottom rails are affixed to the vertical posts, the picket can slide up into the top rail and then be inserted into the bottom rail, where it may rest.

Once the pickets are inserted into the affixed top and bottom rails, the locking strip is manipulated to lock the pickets into place. For example, the locking strip slides within the tracks in the inner chamber, such that a narrower opening in the locking strip engages the pickets. The sliding may be performed using an engaging tool that includes a hook extending from a T-shaped handle. The hook is inserted into an open portion of the rail, such as a bottom surface that is out of view when the railing is assembled. The hook contacts the locking strip, and then may be pulled laterally to slide the locking strip into the engaged position. Secure engagement may be verified using the engaging tool. For example, the T-shaped handle may be sized to contact an adjacent picket once the locking strip is manipulated into the fully engaged position.

One aspect of the disclosure provides a method of assembling a railing, the method comprising mounting at least one vertical post, affixing a bottom rail to the at least one vertical post, the bottom rail including at least one bottom rail slot at a top surface of the bottom rail and at least one ledge within an internal cavity of the bottom rail, affixing a top rail to the at least one vertical post, the top rail having an inner portion and an outer portion at least partially covering the inner portion, the inner portion including at least one top rail slot, inserting a top portion of a first picket into the at least one top rail slot in the inner portion of the top rail, wherein during the inserting the top portion of the first picket extends beyond a top surface of the inner portion and into an internal chamber between the inner portion and the outer portion, and inserting a bottom portion of the first picket into the at least one bottom rail slot, wherein after the inserting the bottom portion of the first picket rests on the at least one ledge within the internal cavity of the bottom rail.

According to some examples, after the inserting of the bottom portion of the first picket, the top portion of the first picket may slide down, partially out of the internal chamber between the inner portion and the outer portion of the top rail.

At least one of the top or the bottom rails may include a shelf supporting a locking strip, the locking strip having an aperture with a transitional shape that transitions between a larger opening and a smaller opening, the smaller opening sized to securely fit around a perimeter of the first picket. In such examples, the method may further include engaging, though a channel in the at least one or the top or the bottom rails, the locking strip, and sliding the locking strip such that the smaller opening of the aperture secures the first picket. Engaging the locking strip may include inserting a hook portion of a tool through the channel, wherein the tool is sized such that when a handle portion of the tool abuts a surface of the top or bottom rail, the hook portion is in position to engage the locking strip. Sliding the locking strip may comprise gripping the handle portion of the tool and sliding the tool laterally. Moreover, the method may further comprise determining whether the locking strip has securely engaged the first picket, wherein the locking strip securely engages the first picket when the handle portion of the tool abuts an adjacent picket.

According to some examples, both the top rail and the bottom rail each include a separate locking strip, further comprising engaging each locking strip and sliding each locking strip to secure the first picket, such that the first picket is secured near both its top portion and its bottom portion.

According to some examples, the at least one vertical post includes at least one opening along a lateral surface, and wherein affixing the bottom rail to the vertical post comprises inserting an end portion of the bottom rail into the at least one opening along the lateral surface. Alternatively or additionally, the at least one vertical post includes at least one bracket along a lateral surface for affixing the bottom rail to the vertical post.

Another aspect of the disclosure provides a kit for assembling a railing, the kit comprising a first vertical post, a second vertical post configured to be mounted a first distance from the first vertical post, a bottom rail, the bottom rail having a length corresponding to the first distance, wherein a first end of the bottom rail is adapted to be affixed to the first vertical post and a second end of the bottom rail is affixed to the second vertical post, the bottom rail including at least one bottom rail slot at a top surface of the bottom rail and at least one ledge within an internal cavity of the bottom rail, a top rail, the top rail having a length corresponding to the first distance, wherein a first end of the top rail is adapted to be affixed to the first vertical post and a second end of the top rail is affixed to the second vertical post, the top rail having an inner portion and an outer portion at least partially covering the inner portion, the inner portion including at least one top rail slot, and at least one picket, the at least one picket having a top portion and a bottom portion, the top portion of the at least one picket adapted to be inserted into the at least one top rail slot in the inner portion of the top rail, wherein during the inserting the top portion of the at least one picket extends beyond a top surface of the inner portion and into an internal chamber between the inner portion and the outer portion, and wherein the bottom portion of the at least one picket is adapted to be inserted into the at least one bottom rail slot, wherein after the inserting the bottom portion of the first picket rests on the at least one ledge within the internal cavity of the bottom rail.

According to some examples, at least one of the top or the bottom rails includes a channel extending at least partially along a length of an underside of the rail. At least one of the top or the bottom rails may include a shelf supporting a locking strip, the locking strip having an aperture with a transitional shape that transitions between a larger opening and a smaller opening, the smaller opening sized to securely fit around a perimeter of the first picket. In some embodiments, both the top rail and the bottom rail each include a separate locking strip.

The kit may further include a tool having a hook portion and a handle portion, the hook portion configured to engage the locking strip when inserted into the channel and when the handle portion abuts the underside of the rail. The handle portion of the tool may have a length corresponding to a distance between an engaging interface of the locking strip and an adjacent picket.

Another aspect of the disclosure provides a tool for locking a locking strip within a rail, the tool comprising a hook portion extending a first predetermined distance in a first direction, the first predetermined distance corresponding to a distance between an underside surface of the rail and location of a support shelf for a locking strip within a cavity of the rail, and a handle portion extending a second predetermined distance in a second direction perpendicular to the first direction, the second predetermined distance corresponding to a distance between an engaging interface of the locking strip when the locking strip is in a locked position and a position of a picket adjacent the engaging interface when the locking strip is in a locked position. In some examples, the handle portion is T-shaped.

DETAILED DESCRIPTION

An example picket and rail system is provided which allows for quick and easy replacement of damaged pickets, while still providing a secure locking connection between components of the system. A locking strip is inserted into a rail, for example, as described in detail in U.S. patent application Ser. No. 14/967,275, the disclosure of which is hereby incorporated herein by reference. A plurality of pickets are positioned through aligning apertures in the locking strip and the rail. The apertures in the locking strip are shaped to as to have a decreased width at a second end as compared to a first end. In this regard, once the pickets are in place within the rail, the locking strip may be moved laterally with respect to the rail, such that the second end of the aperture, having the smaller width, engages the picket and holds it in place when the locking strip is moved to the locking position.

Figure 1:
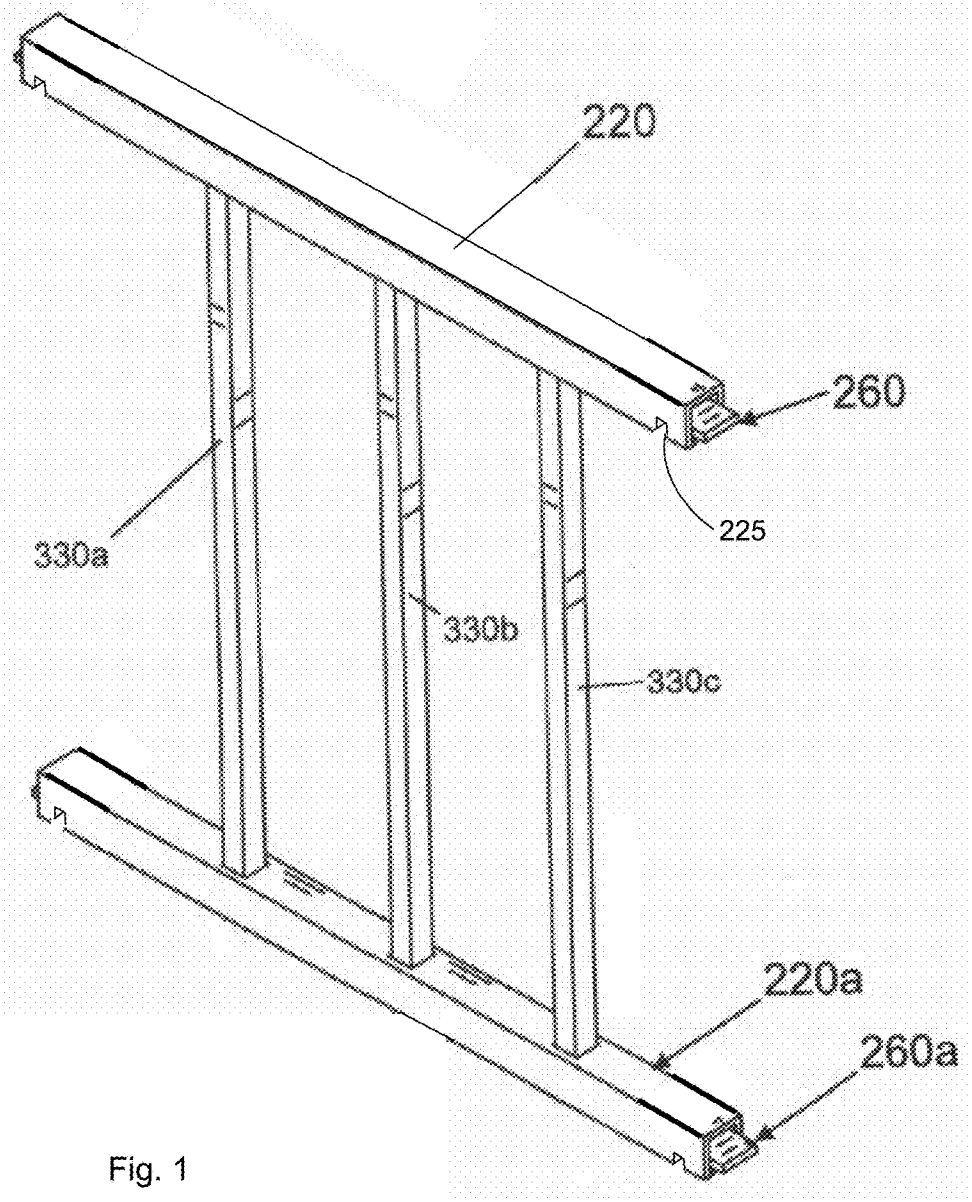
FIG. 1 is a perspective view of an example railing according to aspects of the disclosure.

FIG. 1 provides a perspective view of an example railing according to aspects of the disclosure. The railing includes a top rail 220, a bottom rail 220*a*, and a plurality of pickets 330*a-c*. While a few pickets are shown within a short section of railing, it should be understood that longer sections of railing may be implemented, with more or fewer pickets. As shown, each of the pickets terminates at either end within the rails. For example, a first upper end of the pickets terminates within the top rail, and a second bottom end of the pickets terminates within the bottom rail.

According to some examples, the top and/or bottom rails 220, 220*a* may include one or more grooves 225 on an underside of the rail. Such grooves 225 may provide for identifying where the horizontal rail should stop/terminate at the vertical posts. For example, the vertical posts may include a cutout into which the rails are inserted, wherein the groove 225 identifies where the horizontal rail stops at vertical post.

Locking strips 260 and 260*a*, described in further detail below, secure the pickets in place once inserted into the rails by sliding laterally in a first direction within the rails. If desired, the locking strips may conversely be manipulated to disengage the pickets, for example, by sliding laterally in a second opposite direction. This may allow for removal and replacement of individual pickets.

Figure 2:
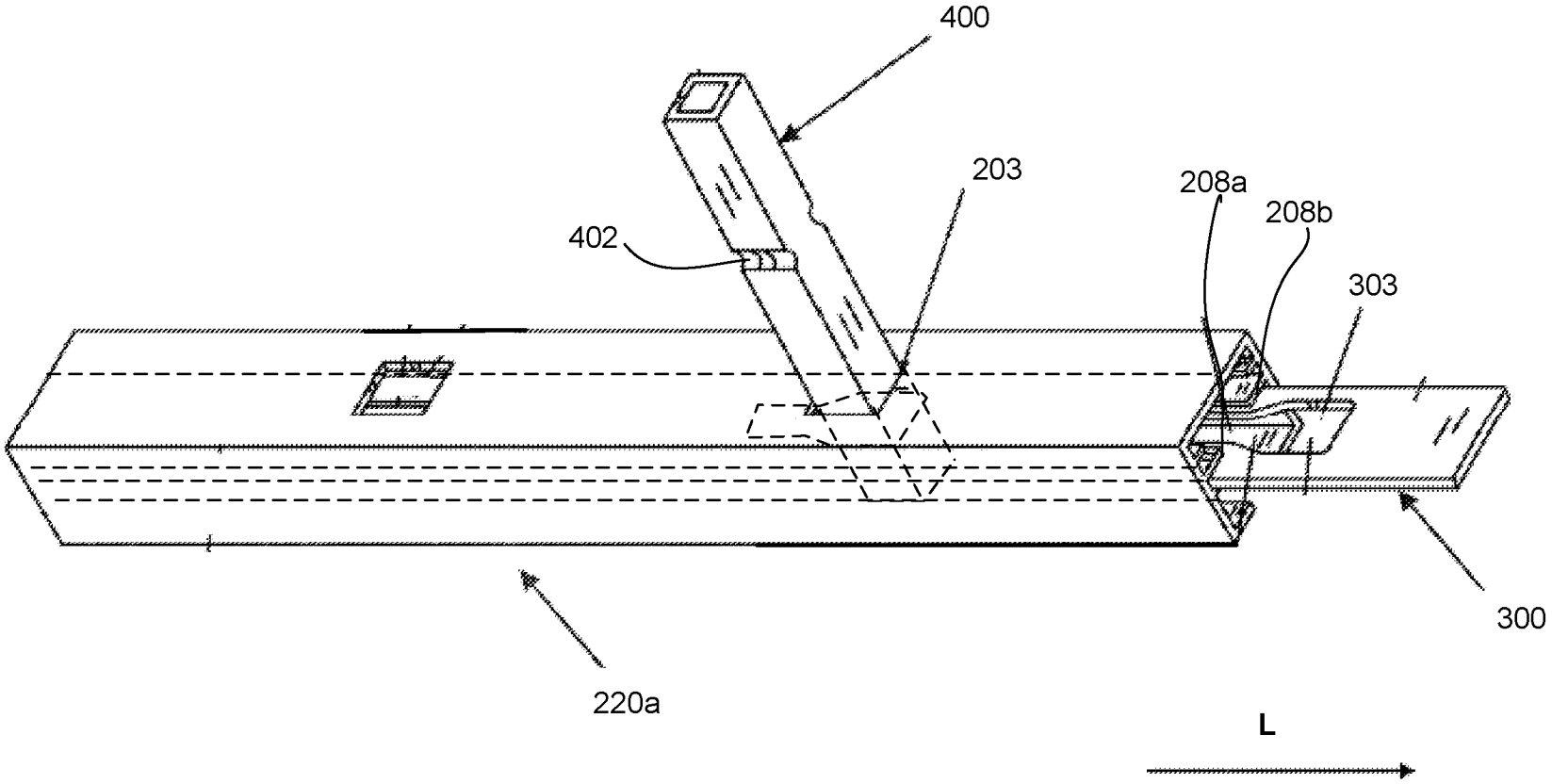
FIG. 2 is a perspective view of a bottom rail in accordance with aspects of the disclosure.

FIG. 2 shows a perspective view of the bottom rail 220*a* in accordance with an embodiment. The rail 220*a* may be made of a hard metal such as steel or aluminum, wood, vinyl or any other known railing material. The rail 220*a* is substantially U-shaped, and includes exterior surfaces and interior surfaces. The exterior surface has openings 203, which may be sized and shaped in accordance with corresponding pickets to be inserted therethrough. For example, the openings 203 may be substantially square or rectangular, as shown, or any other shape.

A bottom surface of the rail 220*a* may include a narrow opening that runs along an entire length of the rail or along a portion of the rail. A width of the opening is sized to be narrower than a width of the picket, such that the picket does not extend through the opening but rather rests upon the bottom portion of the rail. However, the opening may be wide enough to allow for the engagement tool, described in further detail in connection with FIGS. 7-10 below, to be inserted into the rail and engage the locking strip. By way of example only, the picket may be approximately ¾ inch, and the opening at the bottom portion of the bottom rail may be ⅝ inch or less, such that the width of the opening is less than the width of the picket. As another example, for a 1 inch wide picket, the opening can be ¾ inch, ⅞ inch or any other dimension less than 1 inch. In that regard, the opening in the bottom portion of the bottom rail is sized so pickets rest on that bottom portion, and therefore the opening may be sized based on the picket. The opening may be large enough, however, to fit the engaging tool, as discussed further below.

As shown in FIG. 2, the picket 400 may be inserted through the opening 203 and aperture 303. Where the picket 400 is surrounded by the larger portion of the aperture 303, the locking strip is in a first unlocked state. In some examples, the picket 400 may include a notch 402 along one or more side surfaces of the picket. The notch 402 may be used, for example, to secure the picket 400 by the locking strip. Accordingly, the notch 402 may be formed at a position along the picket 400, wherein the position corresponds to placement of the locking strip when the railing is assembled.

The rail 220*a* may include flanges 208*a,b* extending from opposing interior side surfaces, the flanges forming one or more tracks or shelves within the rail 220*a*. Each of the flanges or protrusions may run the length of the rail 220*a*. The locking strip 300 may be inserted into the rail 220*a*, such as by being pushed along one of the one or more tracks. The locking strip may be manipulated into a second position, shown in FIG. 3, using the engaging tool. For example, a hook portion of the engaging tool may be inserted into the opening in the bottom portion of the rail 220*a*, and pulled laterally to pull the locking strip into a second locked position.

Figure 3:
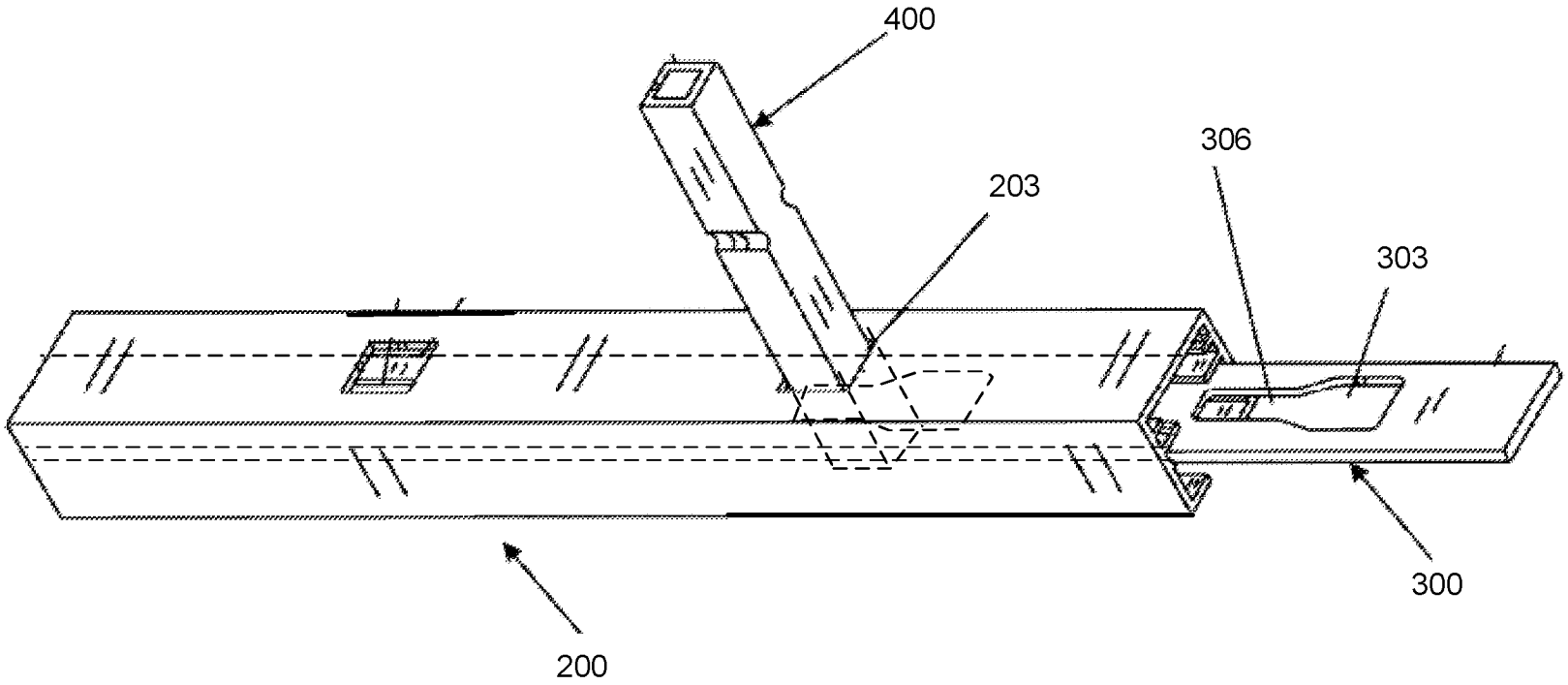
FIG. 3 is a perspective view of an assembled locking strip, rail, and picket, wherein the locking strip has been pulled into the locked state in accordance with aspects of the disclosure.

FIG. 3 shows a perspective view of the assembled locking strip 300, rail 200, and picket 400, wherein the locking strip 300 has been pulled in direction L into the locked state. In this state, the picket 400 is surrounded by the smaller portion 306 of the aperture 303, such that inner edges of the locking strip 300 within the aperture 303 fit snugly against the slots of the picket 400. In this regard, lateral and vertical movement of the picket 400 within the rail 200 is mostly prohibited.

Figure 4A:
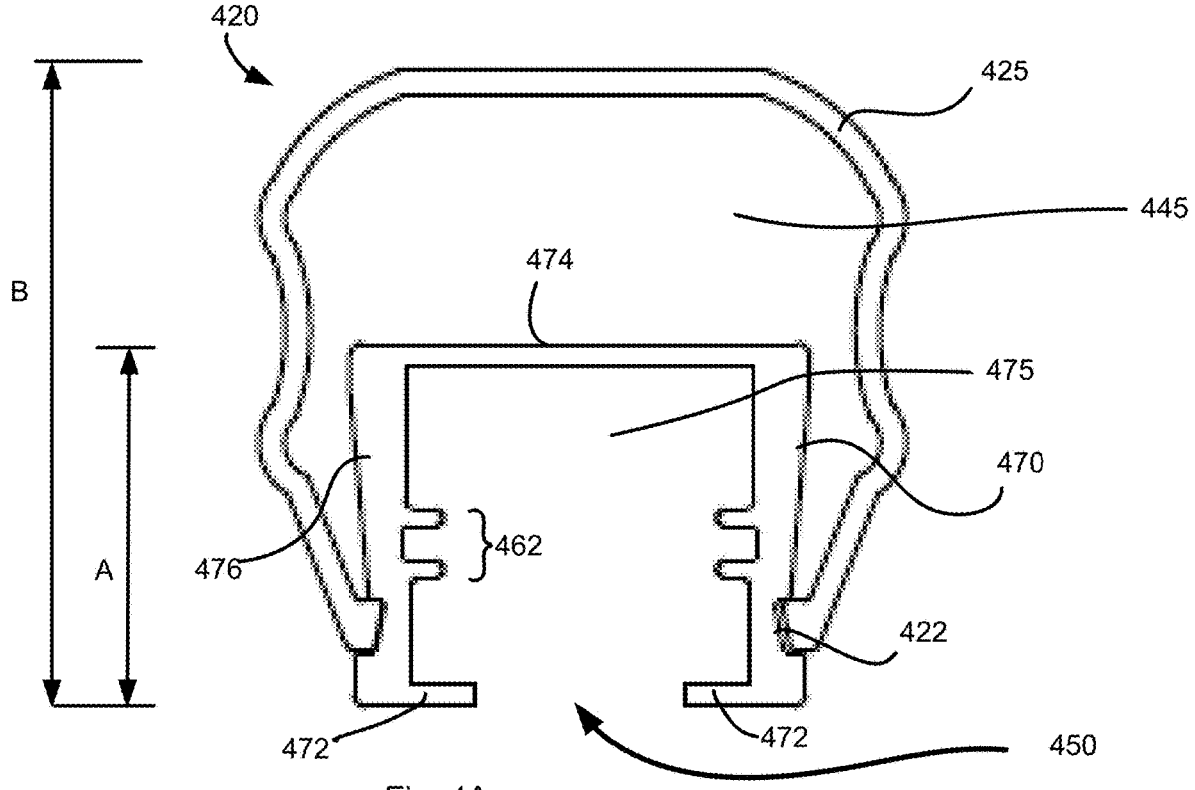
FIG. 4A provides a side view of an example railing top rail according to aspects of the disclosure.

FIG. 4A provides a side view of an example railing top rail 420. In this example, the top rail 420 includes an inner portion 470 having a vertical depth A and an outer portion 425 having a vertical depth B. The vertical depth B is greater than a vertical depth of an internal chamber of the bottom rail. The inner portion 470, as shown, is generally U-shaped, having an internal chamber 475. The inner portion 470 sits within an internal chamber 445 of the outer portion 425, and may be affixed to the outer portion 425 at one or more points, such as at junction point 422, for example by welding, interlocking fit, or other mechanisms for fixation.

The inner portion 470 may include a top edge 474 connecting two side edges 476. According to some examples, the inner portion 470 may also include a bottom edge 472 extending partially between the side edges 476. For example, as shown, the bottom edge 472 includes a short extension from each side edge 476, leaving a channel 450 open therebetween. Such bottom edge 472 may be used for seating the rail 420 within a vertical post and/or bracket. According to other examples, however, the inner portion 470 may omit the bottom edge and instead be fully open on a bottom side.

The inner portion 470 includes tracks 462, wherein the tracks 462 may be used to retain placement of a locking strip. For example, the tracks 462 may be formed by one or more extensions protruding from within inner surfaces of the side edges 476. While the tracks 462 are shown in this example as being generally midway along the inner surface of the side edges 476 between the bottom edge 472 and the top edge 474, in other examples the tracks 462 may be positioned higher or lower along such inner surface. For example, the tracks 462 may alternatively be positioned closer to the top edge 474. Placement of the tracks 462 may impact a minimum size for the aperture 478. For example, by moving the tracks 462 closer to the top edge 474, a size of the aperture 478 in the top edge 474 may be reduced despite use of a same size picket. Moreover, while one set of tracks 462 is shown, in other examples additional sets of tracks may also be included.

Figure 4B:
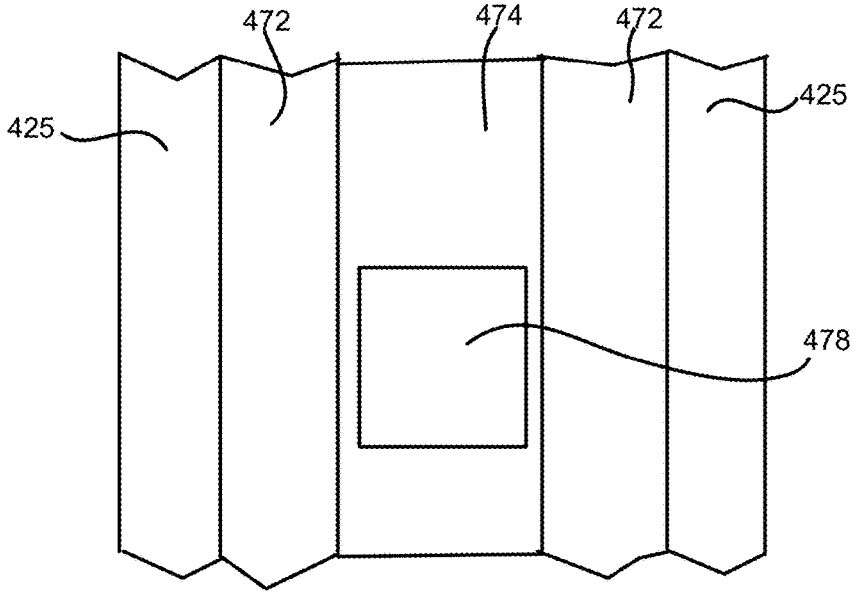
FIG. 4B provides a bottom view of a section of the example railing top rail of FIG. 4A.

As seen in FIG. 4B, the top edge 474 may include a plurality of apertures 478 allowing for pickets to pass through the top edge 474 and into internal chamber 445 of the outer portion 425, such as during insertion of the pickets. For example, the top edge 474 may include an aperture 478 for each picket that will be inserted, wherein the aperture 478 is sized and shaped relative to the picket allowing for the picket to be inserted at an angle and then positioned vertically. When inserted, the picket may extend through to the full vertical depth B of the outer portion 425, if needed. In this regard, pickets may be inserted into the top rail when the top and bottom rails have been affixed to the vertical posts, and then inserted into the bottom rail. Once seated in the bottom rail, the picket may extend through less than the full vertical depth B of the top rail. For example, the picket when seated in the bottom rail may extend slightly beyond the top edge 474 of the inner portion 470.

Figure 4C:
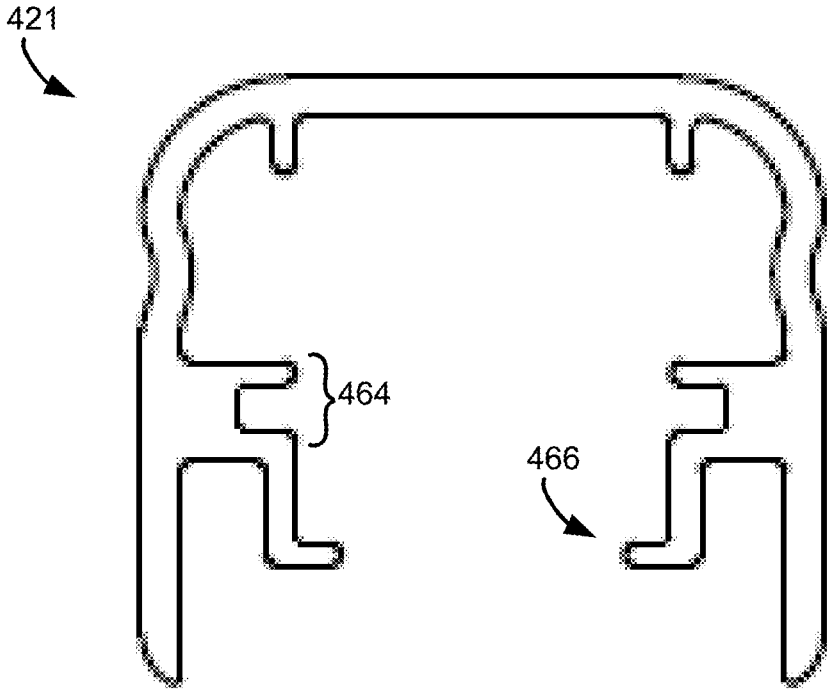
FIG. 4C illustrates an example of a bottom rail according to aspects of the disclosure.

FIG. 4C illustrates an example of a bottom rail 421. The bottom rail 421 also includes tracks 464. Additionally, the bottom rail 421 includes a shelf 466 for supporting the pickets once inserted. For example, a picket inserted through an aperture in a top edge of the bottom rail 421 may slide through an aperture in a locking strip held in tracks 464 and a bottom end of the picket may rest on the shelf 466. While the bottom rail 421 is shown as having a fully open bottom portion, it should be understood that the bottom portion may include a return or extension that extends partially across a bottom edge of the bottom rail 421, similar to the top rail of FIG. 4A. While a few other variations from FIG. 4A are illustrated in FIG. 4C, it should be understood that fewer or additional variations or combinations of variations are possible.

The bottom rail 421 may have a vertical depth less than B. By way of example only, the vertical depth B of the top rail may be approximately 2 inches, while the vertical depth of the bottom rail may be approximately 1 inch. It should be understood that these dimensions are mere examples and may be modified, keeping with the relationship of the vertical depth of the top rail being greater than the vertical depth of the bottom rail.

Some example dimensions for components of the railing are as follows: 34½" from the top of the top rail to the bottom of the bottom rail; 2⅜" Top of top rail to the bottom of top rail 30⅜" from the bottom of the top rail to the top of the bottom rail 1¾" from the top of the bottom rail to the bottom of the bottom rail; 32⅛" picket length; 1¼" is the shelf location in the bottom rail, wherein the picket bottom will rest when inserted into the bottom rail; a 32⅛" picket/baluster slides into the top rail approximately 2⅛"; the picket length extending below the bottom of the top rail is 30", which provide a ⅜" picket clearance. It should be understood that these are examples only merely for illustrating relational sizing of components, and that any or all of the components sizes may be modified.

Figure 5:
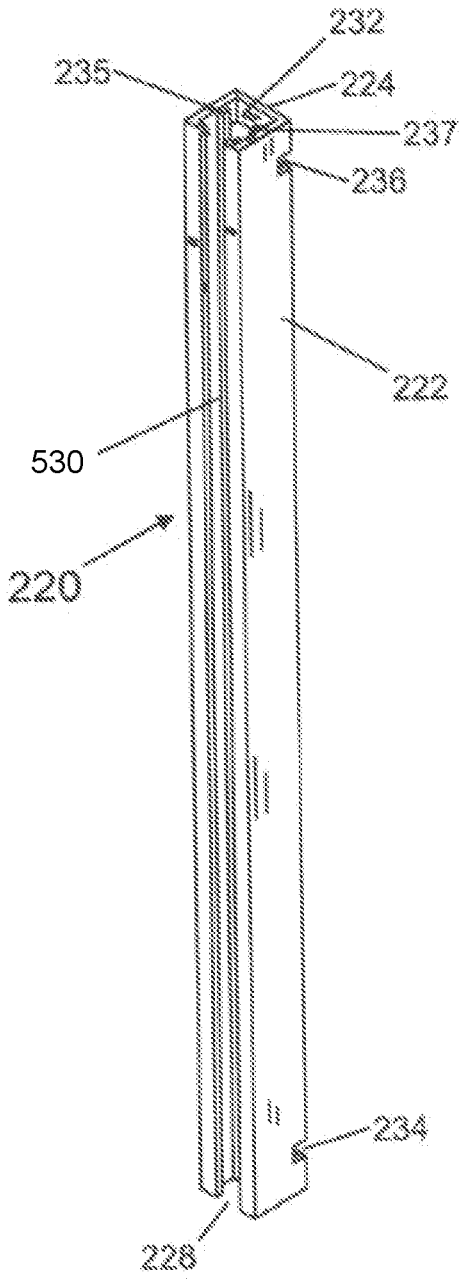
FIG. 5 provides an example embodiment of the rail according to aspects of the disclosure.

FIG. 5 provides an example embodiment of the bottom rail. As shown in FIG. 5, a narrow channel 530 extends along an entire length of the bottom or underside surface of the rail. The narrow channel 530 may again be used to allow for engagement of the engaging tool with the locking strip. Moreover, because a width of the channel 530 is narrower than a width of the pickets, the pickets will not slide through the channel 530 but will instead stop at the bottom interior surface of the bottom rail.

Figure 6:
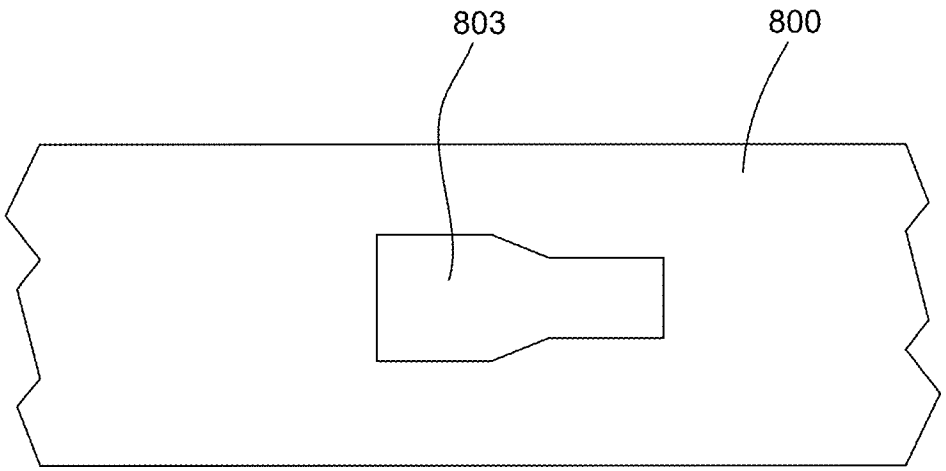
FIG. 6 illustrates a segment of an example locking strip according to aspects of the disclosure.
Figure 7:
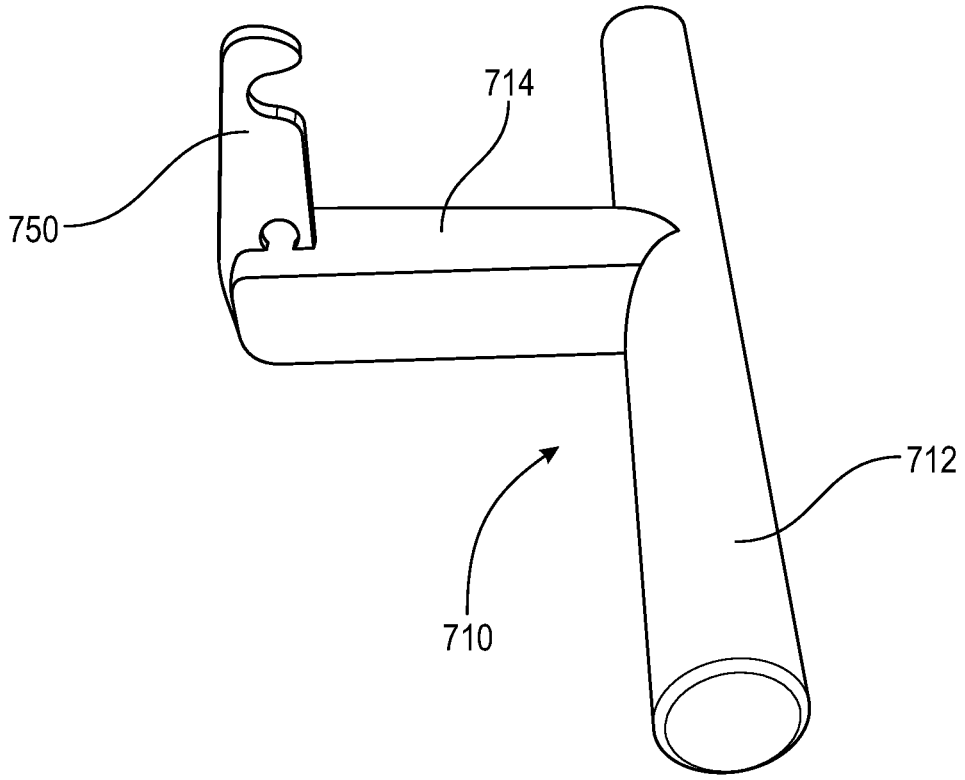
FIGS. 7-10 illustrate various perspectives of an engaging tool according to aspects of the disclosure.
Figure 8:
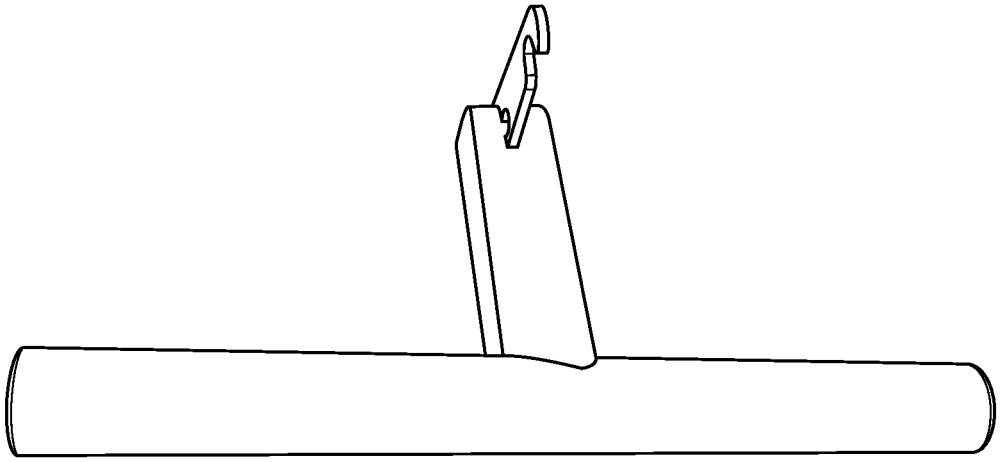

FIG. 6 illustrates a segment of an example locking strip 800, including aperture 803 having a multi-width opening for securing a picket at a narrower portion and releasing the picket at the wider portion.

FIGS. 7-10 illustrate various perspectives of the engaging tool. As shown, the tool includes a T-shaped handle portion 710, including a grip portion 712 and an extension portion 714 between the grip portion 712 and hook portion 750. The hook portion 750 may be used to engage the locking strip, such that grip portion 712 may be pulled laterally, thereby pulling the locking strip by the hook portion 750. Accordingly, the hook portion 750 may be narrow enough to fit within the channel 530 of FIG. 5, such as ⅛" wide and 1⅜" high, by way of example only. This allows the user to insert the hook into the horizontal rail and the hook bottoms out on the top inside bottom of the horizontal rail when the rail is 1" tall.

Figure 9:
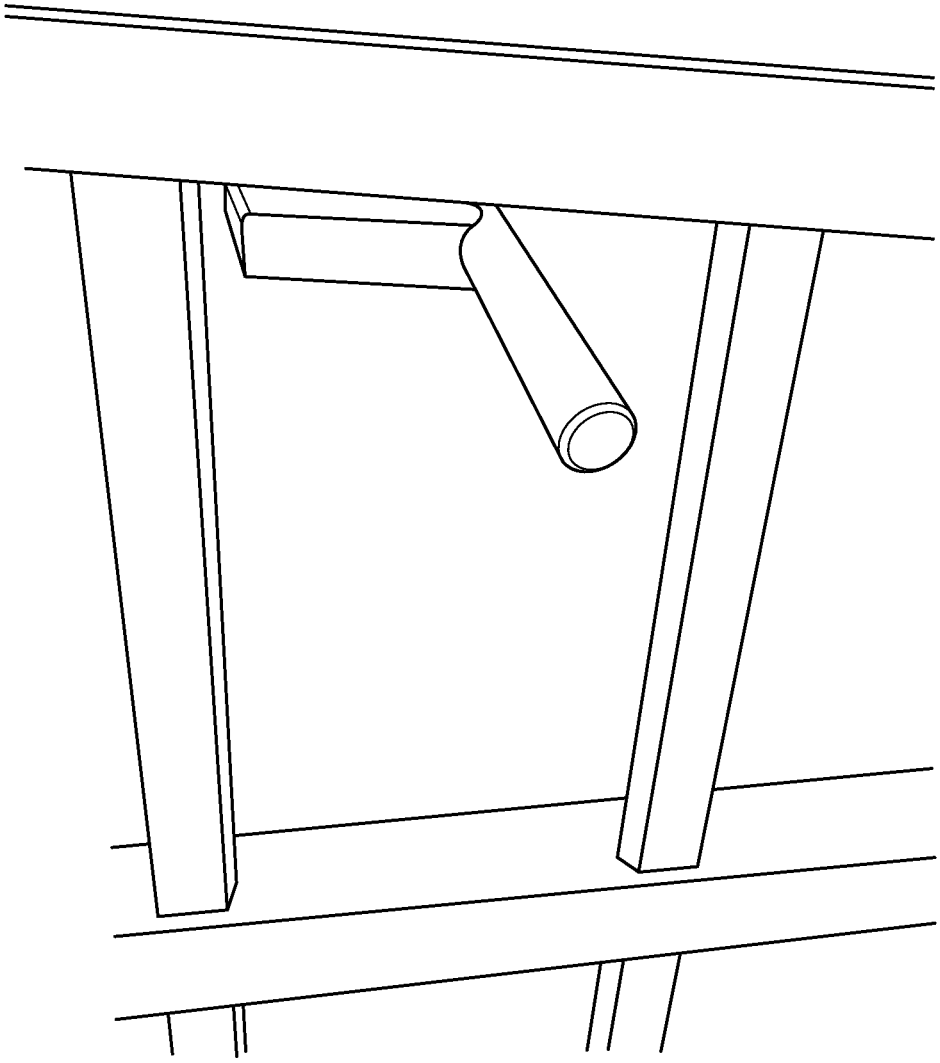
Figure 10:
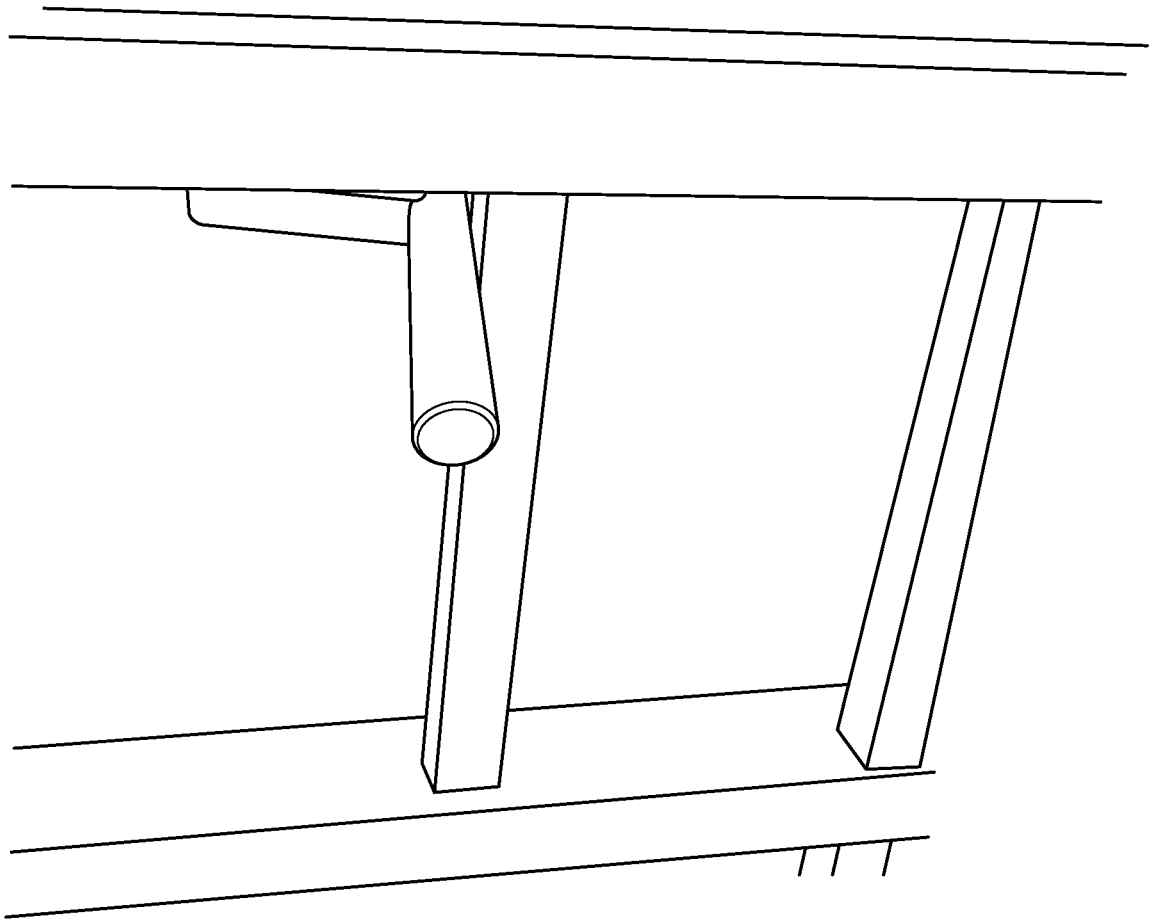

A size of the extension portion 714 may correspond to a distance between pickets, such that the tool can be used to determine whether the locking strip has securely engaged the pickets. For example, as shown in FIG. 9, the pickets are in an unlocked position and the tool is inserted into a bottom portion of the top rail to engage the locking strip. As shown in FIG. 10, the tool has moved the locking strip into the second position, such that the pickets are locked in place. In this position, the grip portion 712 of the handle abuts the adjacent picket. As such, an assembler of the railing can verify that the locking strip is in the locked position.

Figure 11:
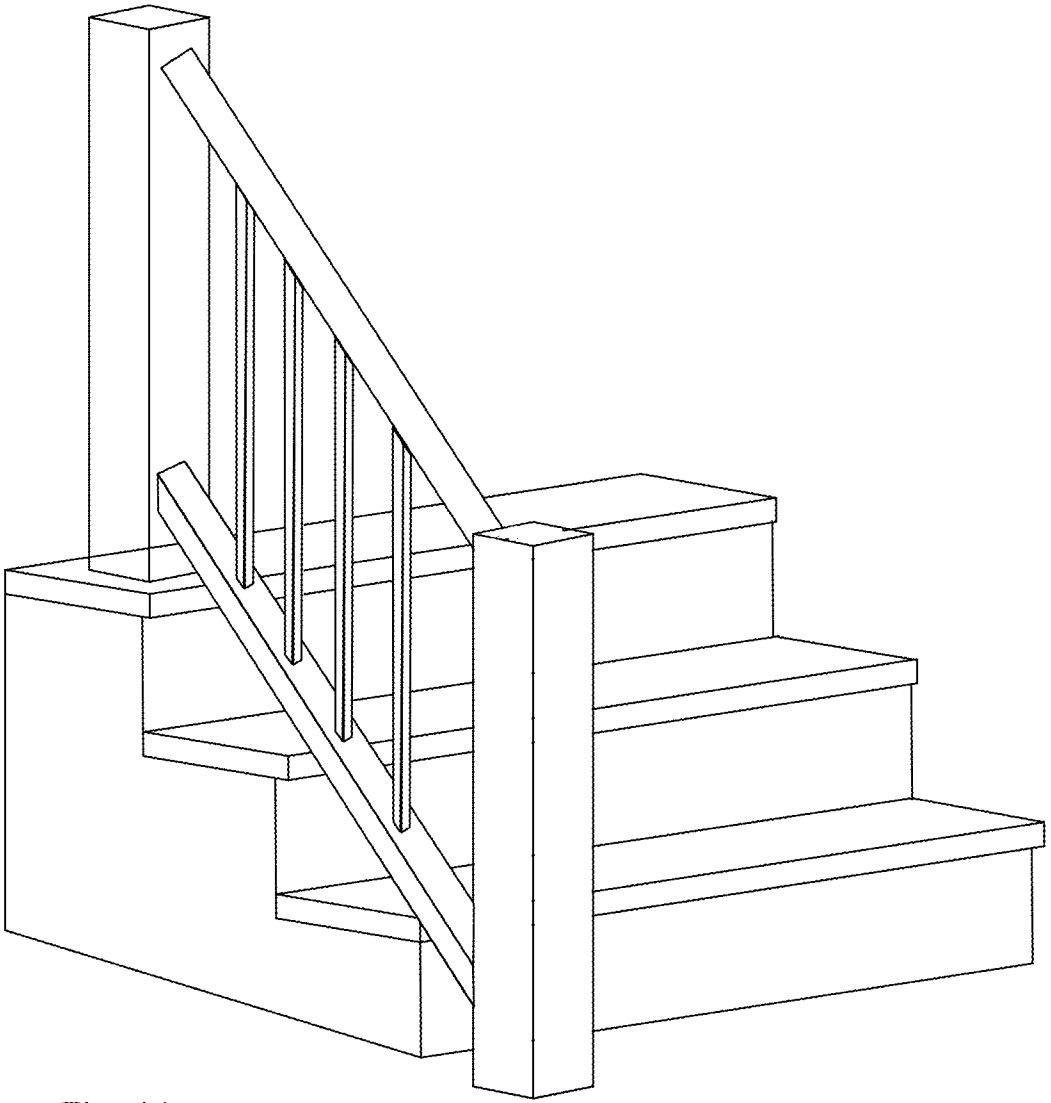
FIG. 11 illustrates an example use case, where the pickets extend vertically although the rails are on a grade.

FIG. 11 illustrates an example use case, where the pickets extend vertically although the rails are on a grade. In this example, the pickets may each rotate within the apertures of the rail and locking strip, such that a top portion of the pickets forms a first obtuse angle with respect to a top surface of the rail, and a second acute angle on an opposing side of the picket. In other words, a longitudinal axis of the picket is non-perpendicular with respect to a longitudinal axis of the rail. The locking strip, however, will remain secured in place with respect to the rail, regardless of the rotation of the pickets. For example, the slots in the pickets which engage with the narrower portion of the aperture in the locking strip may have a height that is greater than a thickness of the locking strip. Accordingly, the slots may allow for some movement of the picket within the aperture of the locking strip in a rotational direction, but substantial movement in an up-down or side-side direction will be limited by the height of the slot and/or a dimension of the opening in the rails through which the picket is inserted.

Figure 12:
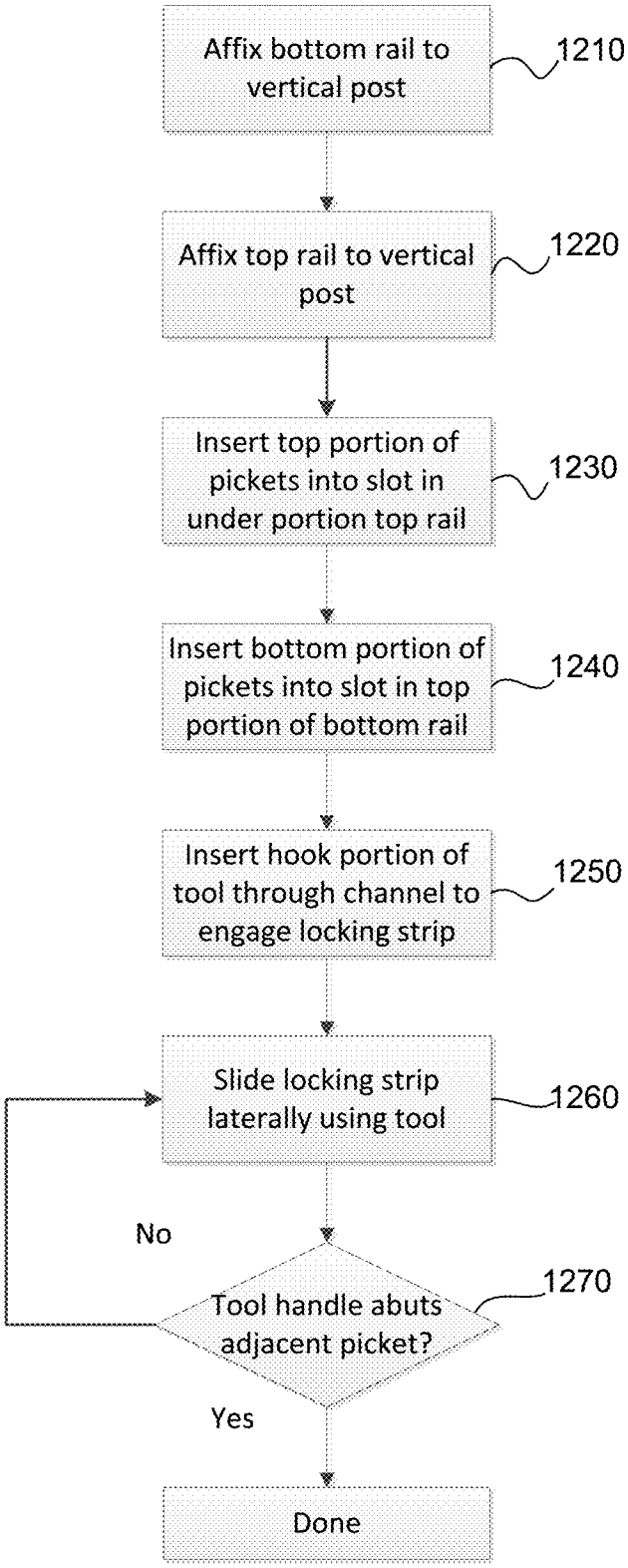
FIG. 12 is a flow diagram illustrating an example method of assembling the railing according to aspects of the disclosure.
Figure 13:
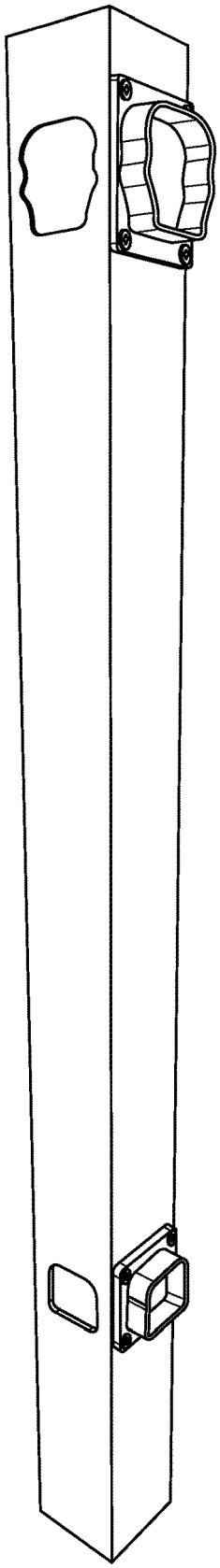
FIG. 13 illustrates an example post according to aspects of the disclosure.

FIG. 12 is a flow diagram illustrating an example method of assembling the railing described above. While the operations are illustrated in a particular order, it should be understood that the order of operations may be modified and that some operations may be performed simultaneously. Moreover, operations may be added or omitted.

In step 1210, a bottom rail is affixed to one or more vertical posts. For example, two vertical posts may be fixed in the ground or on a floor surface on which the railing is to be placed. The vertical posts may be positioned at a distance from one another, wherein the distance corresponds to a length of the bottom rail. According to one example, each vertical post may include an opening on a lateral surface, wherein the opening is sized and shaped and positioned to receive the bottom rail. In such examples, the bottom rail may be inserted into the openings in the lateral surfaces of the vertical posts. Alternatively or additionally, each vertical post may include brackets or other mechanisms for securing the rail.

In step 1220, the top rail is affixed to the vertical post. For example, similar to the bottom rail, the top rail may be inserted into a second opening in a lateral surface of the vertical post that is sized, shaped, and positioned to receive the top rail. According to other examples, the top rail may be affixed to the vertical posts by affixing the top rail to a top surface of the vertical posts, which may or may not later be donned with a cap.

In step 1230, a top portion of a first picket is inserted into the top rail. For example, an underside surface of the top rail includes one or more slots for receiving pickets, as described above in connection with FIGS. 4A-B. As such, a top portion of the first picket is inserted into the slot in the underside surface of the top rail.

In step 1240, a bottom portion of the first picket is inserted into the bottom rail. For example, a top surface of the bottom rail may include one or more slots for receiving one or more pickets. Accordingly, the bottom portion of the first picket may be inserted into the bottom rail. In doing so, the top portion of the first picket may be raised up into the top rail to a height higher than its final resting height. For example, referring to FIG. 4A, the top portion of the first picket may be inserted past top edge 474 of inner portion 470 into internal chamber 445 of outer portion 425. As such, the bottom portion of the first picket may be angled into the slot in the bottom rail. Once inserted into the slot in the bottom rail, the first picket may slide down to its resting position. For example, the first picket may slide downwards as a result of an applied downward force and/or as a result of gravity. For example, with reference to FIG. 4C, the resting position may include a bottom surface of the first picket resting on shelf 466. As the first picket slides down to this resting position, the top portion of the picket may also slide out of internal chamber 445, such that less of the top portion of the first picket remains within the internal chamber 445.

The insertion of the top portion of the picket and the bottom portion of the picket may be repeated for second, third, fourth, etc. pickets until all of the pickets have been inserted for the stretch of railing between the two vertical posts.

In step 1250, a tool is used to engage the locking strip, such as the tool described above in FIGS. 7-10. For example, referring to FIG. 4A, a hook portion of the tool may be inserted through channel 450 of the top rail. Referring to FIG. 5, the hook portion of the tool may be inserted through the channel 530. Once inserted, the hook may engage a locking strip (e.g., locking strip 800 of FIG. 6).

In step 1260, the tool is used to slide the locking strip laterally, such that a larger portion of aperture 803 that surrounds the picket during picket insertion is moved away from the picket, and thus smaller portion of the aperture 803 snugly surround the picket, thereby holding the picket in place.

In step 1270, it is determined whether a handle of the tool abuts a second picket adjacent to the first picket. If so, it may be determined that the pickets are fully engaged by the locking strip. Otherwise, the method may return to step 1260, such that the tool is used to further slide the locking strip until it reaches a fully engaged position, which is signified by the tool handle abutting the adjacent picket.

The subject matter described herein is advantageous in that it provides for a secure and sturdy interlocking railing system. It allows for rails to be installed prior to the pickets, thereby creating a guard rail preventing a fall. For example, traditional railing typically require two people to assemble. When assembling near an edge that has a high drop to the ground, this creates a dangerous situation. By enabling the rails to be assembled to the posts prior to the pickets, the rails create a barrier to help prevent the person installing the railing from falling. By requiring only a single person to assemble, this further reduces the possibility of an accidental fall. Moreover, this system allows for easy disengagement of the locked components, thereby allowing for ease of removal and replacement of one or more of the components.

As these and other variations and combinations of the features discussed above can be utilized without departing from the subject matter as defined by the claims, the foregoing description of embodiments should be taken by way of illustration rather than by way of limitation of the subject matter as defined by the claims. It will also be understood that the provision of the examples described herein (as well as clauses phrased as "such as," "e.g.", "including" and the like) should not be interpreted as limiting the claimed subject matter to the specific examples; rather, the examples are intended to illustrate only some of many possible aspects.

The invention claimed is:

1. A method of assembling a railing, the method comprising:

mounting at least one vertical post;

affixing a bottom rail to the at least one vertical post, the bottom rail including at least one bottom rail slot at a top surface of the bottom rail and at least one ledge within an internal cavity of the bottom rail;

affixing a top rail to the at least one vertical post, the top rail having an inner portion and an outer portion at least partially covering the inner portion, the inner portion including at least one top rail slot;

inserting a top portion of a first picket into the at least one top rail slot in the inner portion of the top rail, wherein during the inserting the top portion of the first picket extends beyond a top surface of the inner portion and into an internal chamber between the inner portion and the outer portion; and inserting a bottom portion of the first picket into the at least one bottom rail slot, wherein after the inserting the bottom portion of the first picket rests on the at least one ledge within the internal cavity of the bottom rail; and wherein after the inserting of the bottom portion of the first picket, the top portion of the first picket slides down, partially out of the internal chamber between the inner portion and the outer portion of the top rail.

2. The method of claim 1, wherein at least one of the top or the bottom rails includes a shelf supporting a locking strip, the locking strip having an aperture with a transitional shape that transitions between a larger opening and a smaller opening, the smaller opening sized to securely fit around a perimeter of the first picket, the method further comprising:

engaging, though a channel in the at least one or the top or the bottom rails, the locking strip; and sliding the locking strip such that the smaller opening of the aperture secures the first picket.

3. The method of claim 2, wherein engaging the locking strip comprises inserting a hook portion of a tool through the channel, wherein the tool is sized such that when a handle portion of the tool abuts a surface of the top or bottom rail, the hook portion is in position to engage the locking strip.

4. The method of claim 3, wherein sliding the locking strip comprises gripping the handle portion of the tool and sliding the tool laterally.

5. The method of claim 4, further comprising determining whether the locking strip has securely engaged the first picket, wherein the locking strip securely engages the first picket when the handle portion of the tool abuts an adjacent picket.

6. The method of claim 2, wherein both the top rail and the bottom rail each include a separate locking strip, further comprising engaging each locking strip and sliding each locking strip to secure the first picket, such that the first picket is secured near both its top portion and its bottom portion.

7. The method of claim 1, wherein the at least one vertical post includes at least one opening along a lateral surface, and wherein affixing the bottom rail to the vertical post comprises inserting an end portion of the bottom rail into the at least one opening along the lateral surface.

8. The method of claim 1, wherein the at least one vertical post includes at least one bracket along a lateral surface for affixing the bottom rail to the vertical post.

9. A kit for assembling a railing, comprising:

a first vertical post;

a second vertical post configured to be mounted a first distance from the first vertical post;

a bottom rail, the bottom rail having a length corresponding to the first distance, wherein a first end of the bottom rail is adapted to be affixed to the first vertical post and a second end of the bottom rail is affixed to the second vertical post, the bottom rail including at least one bottom rail slot at a top surface of the bottom rail and at least one ledge within an internal cavity of the bottom rail;

a top rail, the top rail having a length corresponding to the first distance, wherein a first end of the top rail is adapted to be affixed to the first vertical post and a second end of the top rail is affixed to the second vertical post, the top rail having an inner portion and an outer portion at least partially covering the inner portion, the inner portion including at least one top rail slot; and at least one picket, the at least one picket having a top portion and a bottom portion, the top portion of the at least one picket adapted to be inserted into the at least one top rail slot in the inner portion of the top rail, wherein during the inserting the top portion of the at least one picket extends beyond a top surface of the inner portion and into an internal chamber between the inner portion and the outer portion, and wherein the bottom portion of the at least one picket is adapted to be inserted into the at least one bottom rail slot, and wherein after the inserting of the bottom portion of the first picket, the top portion of the first picket slides down, partially out of the internal chamber between the inner portion and the outer portion of the top rail.

10. The kit of claim 9, wherein at least one of the top or the bottom rails includes a channel extending at least partially along a length of an underside of the rail.

11. The kit of claim 10, wherein at least one of the top or the bottom rails includes a shelf supporting a locking strip, the locking strip having an aperture with a transitional shape that transitions between a larger opening and a smaller opening, the smaller opening sized to securely fit around a perimeter of the first picket.

12. The kit of claim 11, wherein both the top rail and the bottom rail each include a separate locking strip.

13. The kit of claim 11, further comprising a tool having a hook portion and a handle portion, the hook portion configured to engage the locking strip when inserted into the channel and when the handle portion abuts the underside of the rail.

14. The kit of claim 13, wherein the handle portion of the tool has a length corresponding to a distance between an engaging interface of the locking strip and an adjacent picket.

15. A tool for locking a locking strip within a rail, the tool comprising:

a hook portion;

a grip portion; and an extension portion between the hook portion and the grip portion;

wherein the hook portion extends a first predetermined distance in a first direction, the first predetermined distance corresponding to a distance between an underside surface of the rail and location of a support shelf for a locking strip within a cavity of the rail, the hook portion comprising an engaging surface on a side proximal to the extension portion, the engaging surface including a notch sized and shaped to receive the locking strip; and wherein the extension portion extends a second predetermined distance in a second direction perpendicular to the first direction and terminates at the grip portion, the second predetermined distance corresponding to a distance between an engaging interface of the locking strip when the locking strip is in a locked position and a position of a picket adjacent the engaging interface when the locking strip is in a locked position, such that the grip portion abuts the adjacent picket when the locking strip is in the locked position.

16. The tool of claim 15 wherein the extension portion and the grip portion form a T shape.

17. The tool of claim 15, the hook portion having a width of ⅛ inch.

18. The tool of claim 15, the hook portion having a height of 1 and ⅜ inch.

19. The tool of claim 15, wherein the tool is included in a kit, the kit comprising:

the rail, the rail comprising at least one of:

a bottom rail including at least one bottom rail slot at a top surface of the bottom rail and at least one ledge within an internal cavity of the bottom rail;

a top rail having an inner portion and an outer portion at least partially covering the inner portion, the inner portion including at least one top rail slot; and a plurality of pickets each having a top portion and a bottom portion, the top portion adapted to be inserted into the at least one top rail slot in the inner portion of the top rail, and the bottom portion adapted to be inserted into the at least one bottom rail slot.

* * * * *